US006890264B2

(12) United States Patent
Verona

(10) Patent No.: US 6,890,264 B2
(45) Date of Patent: May 10, 2005

(54) REMOVABLE BILLIARD CUE TIP

(76) Inventor: Steven N. Verona, 6206 Olde Orchard Dr., Columbus, OH (US) 43213

( * ) Notice: Subject to any disclaimer, the term of this patent is extended or adjusted under 35 U.S.C. 154(b) by 2 days.

(21) Appl. No.: 10/282,171

(22) Filed: Oct. 28, 2002

(65) Prior Publication Data

US 2004/0082397 A1 Apr. 29, 2004

(51) Int. Cl.[7] ..... A63D 15/02; A63B 67/00
(52) U.S. Cl. ..... 473/49; 473/50
(58) Field of Search ..... 473/46–50, 44, 473/51, 1; D21/726

(56) References Cited

U.S. PATENT DOCUMENTS 60,503 A * 12/1866 Gissinger ..... 473/50
1,605,240 A * 11/1926 Johnson ..... 473/49
D370,515 S * 6/1996 Wolff ..... D21/726
D391,315 S * 2/1998 Golz ..... D21/726
D391,325 S * 2/1998 Golz ..... D21/726
D391,326 S * 2/1998 Golz ..... D21/726
D391,328 S * 2/1998 Golz ..... D21/726
5,725,436 A * 3/1998 Miller et al. ..... 473/46

* cited by examiner

*Primary Examiner*—Mitra Aryanpour
(74) *Attorney, Agent, or Firm*—Jason H. Foster; Kremblas, Foster, Phillips & Pollick

(57) ABSTRACT

A removable billiard cue tip that can be placed on the end of a conventional billiard cue and subsequently removed easily. The removable tip includes a body having a frustoconical outer surface and a chamber therein as defined by an inner sidewall and an endwall with a soft cushion. An o-ring is mounted in a groove in the inner sidewall, and seats against the outer surface of the conventional cue tip when the removable tip is mounted in place.

9 Claims, 1 Drawing Sheet

REMOVABLE BILLIARD CUE TIP

BACKGROUND OF THE INVENTION

1. Field of the Invention

This invention relates generally to billiard cues, and more specifically to a removable tip for a billiard cue.

2. Description of the Related Art

Billiard cues, such as the cues used in the game of pool, are elongated, normally wooden poles. These cues have a smooth, tapered surface, as shown in FIG. 1, and terminate at the narrowest end in a tip 2. The tip is commonly a roughly cylindrical plastic body with a cavity at one end to receive the tapered end of the wooden pole, and a cushion at the opposite end of the plastic body, made of leather, cork or felt. Thus, when a billiard ball is struck, the cushion does not deform the ball, but more importantly, the cushion has a high coefficient of friction which imparts spin to the ball.

Billiard cues used in billiard halls become worn or broken rapidly due to misuse. Players often crush or deform the soft cushion on the tip, thereby leaving the owner or the next player to re-shape the cushion, or break the plastic tip, requiring replacement of the entire tip. However, because pool cue cushions become ruined quickly by careless players, pool hall owners are reluctant to go to the expense of replacing or repairing the tips when necessary. Instead, pool players must re-shape the tips, but this process is time consuming and requires players to carry tools with them. Most players are not interested in re-shaping the tip of a cue that is not their own.

The only existing alternative to re-shaping a cue tip is to bring one's own cue into a pool hall. However, carrying an entire cue is inconvenient, and others will not play against anyone who brings his own cue, because he looks like a professional player. Therefore, the need arises for a device that enables a casual player to play with pool hall cues without the need to repair the cushion or play with a poor tip.

BRIEF SUMMARY OF THE INVENTION

The invention is a device that is adapted to be removably attached to a conventional billiard cue. Conventional billiard cues have an elongated, tapered shaft with a tip. The device comprises a body having a sidewall and an endwall. The sidewall has an outer surface and an inner surface, and the endwall has an outer surface and an inner surface. A chamber is defined by the inner surfaces of the sidewall and the endwall. The chamber is designed to accept the tip of the conventional shaft into the chamber. A cushion is mounted at the outer surface of the endwall for impacting billiard balls.

The invention also includes means for removably mounting the body to the conventional billiard cue at the shaft's tip. In a preferred embodiment, the means comprises at least one groove formed in the inner surface of the sidewall and an o-ring mounted in the groove(s). The o-ring is designed to seat against and frictionally engage the outer surface of the cue tip. Thus, the o-ring thereby removably mounts the body to the conventional billiard cue at the shaft's tip.

In a particularly preferred embodiment, the body's outer surface is cylindrical, and the chamber is cylindrical. The sidewall's inner surface is preferably substantially the same or slightly larger width as the shaft's tip where the sidewall's inner surface is adapted to be mourned in close proximity to the shaft's tip. This provides a friction fit with the shaft tip to maintain the position of the body on the shaft tip. During use, billiard balls are struck by the cushion on the body, rather than the tip of the conventional shaft to which the body is mounted. The invention can therefore be used and cared for by its owner, without using one's own pool cue.

Figure 1:
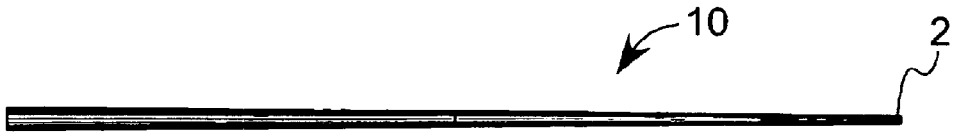
FIG. 1 (PRIOR ART)
FIG. 1 is a side view illustrating a prior art pool cue.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Figure 2:
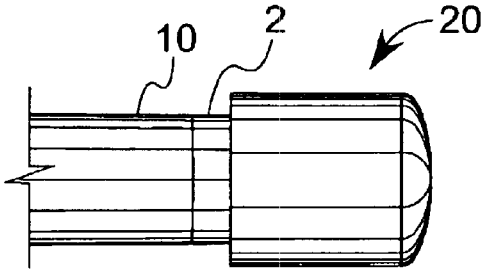
FIG. 2 is a side view illustrating the instant invention mounted to a conventional pool cue.
Figure 3:
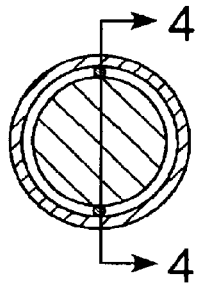
FIG. 3 is an end view illustrating the instant invention mounted to a conventional pool cue.

The preferred removable tip 20 is shown in FIG. 2 mounted to the conventional pool cue 10 of FIG. 1. The removable tip 20, which is best viewed in detail in FIGS. 4 and 5, has a body 30 and a soft cushion 40.

The body 30 has a curved, circular cylindrical exterior surface with an opening at one end, and the cushion 40 is mounted to the opposite end. There is a chamber within the body 30 that is defined by the inner sidewall 32 and endwall 34 (see FIG. 4). The chamber is also preferably circular cylindrical. The body 30 is preferably made of aluminum, plastic or a composite, such as a fiberglass/resin or carbon fiber/resin composite. Of course, there are many other materials from which the body 30 can be made, including other metals, polymers and composites, or ceramics.

The cushion 40 is made of the material of which conventional cue cushions are made, such as leather, cork or felt, and is mounted to the body 30 by adhesive in the preferred embodiment. Alternatively, of course, the cushion 40 can be mounted in a different manner to the body 30. The shape of the cushion 40 is substantially the same as a conventional cue cushion.

Figure 4:
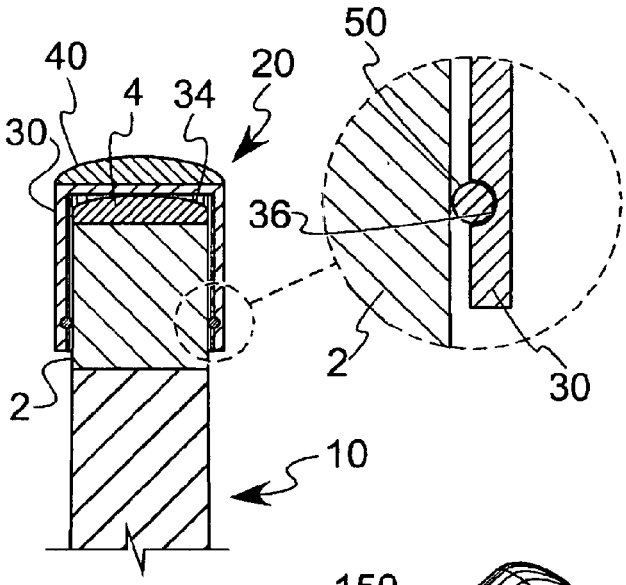
FIG. 4 is a side view in section along the line 4—4 of FIG. 3, and a close-up view of the encircled portion.
Figure 5:
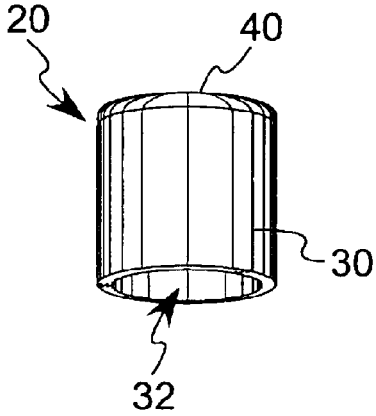
FIG. 5 is a view in perspective illustrating the preferred embodiment of the present invention.

In the preferred method of mounting the removable tip 20 to the conventional cue 10, the tip 2 of the conventional cue 10 is extended into the chamber of the body 30 as shown in FIG. 4. The tip 2 is inserted until the cushion 4 seats gently against the endwall 34 and the inner sidewall 32 comes into close proximity to the outer surface of the conventional tip 2. In the preferred embodiment, an o-ring 50 is mounted in an annular groove 36 formed in the inner sidewall 32 and extends entirely around the inner sidewall 32. The inner surface of the o-ring 50 seats against the outer surface of the conventional tip 2 when the conventional tip 2 is inserted thereinto to accommodate slight variations in tip diameters. Of course, there could be two or more o-rings as desired.

Figure 6:
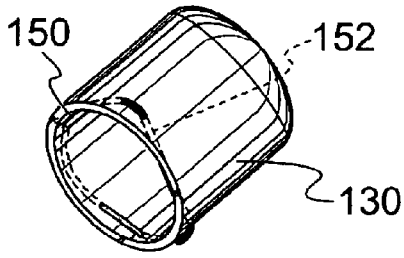
FIG. 6 is a view in perspective illustrating an alternative embodiment of the present invention.

The o-ring 50 is made of a high-friction material, such as rubber, which provides a frictional engagement with the conventional tip 2. Furthermore, the o-ring 50 compresses all around the conventional tip 2 as the removable tip 20 slides onto the conventional tip 2 and any gap between the two decreases. The o-ring 50 applies an inward bias to the conventional tip 2 and an outward bias to the body 30 that retains the removable tip 20 on the conventional tip 2. The bias causes the frictional engagement between the o-ring 50 and the surface of the conventional tip 2 to be high enough to maintain the removable tip 20 on the cue 10 to prevent misalignment and inadvertent falling of the removable tip 20 off the cue 10. In an alternative embodiment shown in FIG. 6, an o-ring 150 is mounted in a groove 152 formed on the outer surface of a body 130. Two or more, and preferably three, points in the groove 152 are deeper than the remaining parts of the grooves and extend entirely through the sidewall to apply a bias to the tip of a conventional cue.

When the pool cue 10 with the removable tip 20 is used, the cue 10 is used in a conventional manner. However, instead of the conventional tip 4 striking a billiard ball, the cushion 40 of the removable tip 20 strikes the ball. Upon impact between the cushion 40 and the ball, the cushion 40 compresses in a conventional manner, and the body 30 can slide slightly farther onto the pool cue 10 as the conventional tip 4 compresses slightly to accommodate the movement. The conventional tip 4 is seated against the endwall 34 in the preferred position. Thus, the feel of the pool cue with the removable tip 20 is virtually identical to that of a conventional pool cue.

The removable tip 20 can be removed by gently pulling away from the cue 10, thereby overcoming the frictional engagement between the o-ring 50 and the conventional tip 2, and sliding the removable tip 20 off of the end of the cue 10. Thus, the removable tip 20 can be removed and transported by its owner for use on another pool cue's less desirable conventional cushion. The invention therefore permits a user to carry a removable pool cue tip having a cushion that remains intact, without the inconvenience and the impression of one who carries his or her own pool cue to a pool hall.

In a preferred embodiment, a cap is made to slide over and cover the removable tip 20 to protect the tip 20, and to prevent chalk on the tip 20 from being rubbed off onto surrounding surfaces, such as the user's hands or pocket. The cap is preferably a soft material that is slightly shorter and wider than the tip 20, so that the tip 20 can slide into the cap with the cushion 40 end first and the outer surface of the body 30 frictionally engages the cap, much like a beverage coolie. Furthermore, a chain, string or other flexible material can be mounted to the cap so that the cap and removable tip 20 can be attached to other, larger structures, such as a key chain.

In an alternative embodiment, the removable tip can be a frustoconical shape, or any decorative or functional shape. The chamber within an alternative embodiment can also be frustoconical. Furthermore, a removable tip can fasten to a conventional cue with something other than one or two o-rings. For example, a removable tip can mount using pressure sensitive adhesive, a snap or other fastening device, including hooks and loops, or a magnet. There are numerous means for mounting the removable tip to a conventional billiard cue, and not all of them can be listed here. The person having ordinary skill in the art will recognize these fasteners and other mounting means as being useful for this purpose.

While certain preferred embodiments of the present invention have been disclosed in detail, it is to be understood that various modifications may be adopted without departing from the spirit of the invention or scope of the following claims.

What is claimed is:

1. A device in combination with a conventional billiard cue having an elongated, tapered shaft with a cushioned tip, the combination comprising:

a) a body having a sidewall and an endwall, the sidewall having an outer surface and an inner surface, and the endwall having an outer surface and an inner surface, and a chamber, defined by the inner surfaces of the sidewall and the endwall, into which the shaft is inserted until the cushioned tip seats against the inner surface of the endwall;

b) a soft cushion mounted at the outer surface of the endwall for impacting billiard balls;

c) a radially inwardly facing groove formed in the inner surface of the sidewall; and d) an o-ring removably mounted in the groove for seating against and frictionally engaging a radially outwardly facing surface of the tapered shaft of the billiard cue, thereby removably mounting the body to the conventional billiard cue at the shaft's tip.

2. The device in accordance with claim 1, wherein the body's outer surface is frustoconical.

3. The device in accordance with claim 1, wherein the chamber is frustoconical.

4. The device in accordance with claim 1, wherein the sidewall's inner surface is substantially the same width as the shaft's tip where the sidewall's inner surface is mounted in close proximity to the shaft's tip.

5. A device adapted to be removably attached to a conventional billiard cue having an elongated, tapered shaft with a cushioned tip, the device comprising:

a) a body having a sidewall and an endwall, the sidewall having an outer surface and an inner surface, and the endwall having an outer surface and an inner surface, and a chamber, defined by the inner surfaces of the sidewall and the endwall, into which the shaft can be inserted until the cushioned tip seats against the inner surface of the endwall;

b) a soft cushion mounted at the outer surface of the endwall for impacting billiard balls;

c) a radially inwardly facing groove formed in the inner surface of the sidewall; and d) an o-ring removably mounted in the groove for seating against and frictionally engaging a radially outwardly facing surface of the tapered shaft of the billiard cue, thereby removably mounting the body to the conventional billiard cue at the shaft's tip.

6. The device in accordance with claim 5, wherein the body's outer surface is frustoconical.

7. The device in accordance with claim 5, wherein the chamber is frustoconical.

8. The device in accordance with claim 5, wherein the sidewall's inner surface is substantially the same width as the shaft's tip where the sidewall+s inner surface is adapted to be mounted in close proximity to the shaft's tip.

9. A method of using a billiard cue having an elongated, tapered shaft with a cushioned tip, the method comprising:

a) inserting the cushioned tip of the tapered shaft into a frustoconical chamber of a body having a sidewall and an endwall, the sidewall having an outer surface and an inner surface, the endwall having an outer surface and an inner surface, a soft cushion mounted to the body at the outer surface of the endwall, wherein the chamber is defined by the inner surfaces of the sidewall and the endwall;

b) sliding the cushioned tip into the chamber until the cushioned tip seats against the endwall's inner surface and an o-ring removably mounted in a radically inwardly facing groove formed in the inner surface of the sidewall seats against and frictionally engages a radially outwardly facing surface of the tapered shaft of the billiard cue, thereby removably mounting the body to the billiard cue at the shaft's cushioned tip; and c) striking a billiard ball with the soft cushion mounted to the body.

* * * * *